United States Patent [19]

Shindou et al.

[11] 4,081,344

[45] Mar. 28, 1978

[54] METHOD FOR ELECTRODEPOSITION REPAIR COATING OF THE END OF AN EASY-OPEN CAN

[75] Inventors: Yoshio Shindou; Makoto Nakamura, both of Yokohama, Japan

[73] Assignee: Nippon Steel Corporation, Tokyo, Japan

[21] Appl. No.: 649,977

[22] Filed: Jan. 19, 1976

[30] Foreign Application Priority Data

Jan. 20, 1975 Japan ..... 50-7847

[51] Int. Cl.[2] ..... C25D 13/18; C25D 13/20

[52] U.S. Cl. ..... 204/181 R

[58] Field of Search ..... 204/181

[56] References Cited

U.S. PATENT DOCUMENTS

| | | | |
|---|---|---|---|
| 3,622,485 | 11/1971 | Preece et al. | 204/181 |
| 3,847,786 | 11/1974 | Landauer et al. | 204/181 |
| 3,878,078 | 4/1975 | Tanaka et al. | 204/181 |
| 4,005,000 | 1/1977 | Kraska | 204/181 |

*Primary Examiner*—Howard S. Williams

*Attorney, Agent, or Firm*—Watson, Leavenworth, Kelton & Taggart

[57] ABSTRACT

In repairing by electrodeposition coating an end or top plate of an easy-open can along a score groove where the material metal has been exposed or along a deteriorated coated film chiefly on the reverse side of said end, a sine wave A. C. voltage is imparted as the bath voltage under the particular conditions, wherein the electric current of reverse direction is effectively utilized to effect penetration of the deteriorated coated part or removal of wax. In this case, special advantage can be obtained if an electrode made of the particular metal having an anodic oxidation film thereon is used.

7 Claims, 5 Drawing Figures

METHOD FOR ELECTRODEPOSITION REPAIR COATING OF THE END OF AN EASY-OPEN CAN

DETAILED DESCRIPTION OF THE INVENTION

This invention relates to a method for repairing or coating by electrodeposition of the top end of an easy-open can along a score groove or line where a metal has been exposed or along a deteriorated coated film on the reverse side of said plate.

Recently, an easy-open type of can for foodstuff which can be opened without the use of any can opener has been rapidly developed. This easy-open type of can has a top plate or end on which a score groove for opening the can has been provided by die work. This die work will naturally cause a part where the material metal has thus been exposed on the surface side of the end, or a part where the coated film once given has thus been deteriorated which occurs chiefly on the reverse side of the end, which usually makes it necessary to repair the part by re-coating. The repair coating can be done chiefly by a lacquer spray method. In case that the content in the can may be readily subjected to corrosion, the double lacquer spray method or the electrodeposition repair coating followed by the lacquer spray is carried out.

Generally, a problem incidental to this repair coating is that not only a repair of a score groove 1 as shown in FIG. 1 but also a repair of a projected part 4 where the coating has been deteriorated as shown in FIG. 2 must be required. The numeral 2 is a tab; 3 is a part to which the tab is fixed; 4 and 5 are the parts where the coated film has been deteriorated by the work, etc. However, in order to repair this deteriorated film or coated part by electrodeposition coating, it becomes necessary to first break the deteriorated coated part or film before the repair coating is carried out. An attempt has been proposed to carry out electrolysis in an aqueous solution containing inorganic salt so as to break this deteriorated film. In this attempt, however, an inorganic ion will attach to the easy-open type end, which ion will spoil an electrodeposition coating bath in the subsequent step, give an adverse effect upon the property of the repair coated film and complicate the steps with high costs.

On the other hand, in the repair coating of the score groove, a lubrication wax, etc. which has been applied to the die will attach the part so that the adhesion power of the electrodeposition film may be lowered.

It is therefore an object of the invention to overcome the disadvantages mentioned above.

It is another object of the invention to provide a repair coated film having excellent appearance and good anti-corrosion property by utilizing an alternating current electrodeposition coating. It is still another object of the invention to prevent an electrolysis peel-off of a sound coated film which has been encountered in the preliminary treatment in the direct current cathode electrolysis while carrying out penetration of the deteriorated film and also removal of the attached wax by effectively utilizing the current of the reverse direction in the alternating current electrodeposition coating.

According to this invention there is provided a method for effecting repair coating, by electrodeposition, of the end of an easy-open can where the metal has been exposed by scoring work or where the coated film has been deteriorated, which comprises imparting a sine wave alternating current voltage of 10 V to 300 V having the frequency of 10 Hz to 10,000 Hz as the bath voltage in an electrodeposition coating bath, adjusting an opposite electrode or electrodes such that the ratio of the coating deposit current of normal direction to that of reverse direction in the initial electric current flowing in the electrodeposition coating is between 1 to 0.1 and 1 to 1, and thereby effecting the pretreatment for electrodeposition coating.

According to this invention, there is further provided a method for effecting repair coating, by electrodeposition, of the end of an easy-open can where the metal has been exposed by scoring work or where the coated film has been deteriorated, which comprises using an electrodeposition bath having temperature between 20° C and 60° C, having pH between 6 and 10 adjusted by ammonia caustic soda, caustic potash or amine and having concentration of 2 to 20%, imparting a sine wave alternating current voltage of 10 V to 300 V having the frequency of 10 Hz to 10,000 Hz as the bath voltage, adjusting an opposite electrode or electrodes such that the ratio of the coating deposit current of normal direction to that of reverse direction in the initial electric current flowing in the electrodeposition coating is between 1 to 0.1 and 1 to 1, effecting the pretreatment for electrodeposition coating, and thereafter effecting a D.C. or A.C. electrodeposition coating.

According to this invention, there is further provided a method for effecting repair coating, by electrodeposition, of the end of an easy-open can where the metal has been exposed by scoring work or where the coated film has been deteriorated, which comprises imparting a sine wave alternating current voltage of 10 V to 300 V having the frequency of 10 Hz to 10,000 Hz as the bath voltage in an electrodeposition coating bath, using an electrode made of Ta, Nb, Zr, Al, Ti or their alloy having an oxidized film of 0.2 $\mu$ or more produced by anodic oxidation treatment, controlling the ratio and arrangement of the electrode or electrodes such that the ratio of the coating deposit current of normal direction to that of reverse direction on the inlet side of the electrodeposition coating bath is between 1 to 0.1 and 1 to 1 and such that the current of reverse direction is, as a whole, 1/10 or less of the coating deposit current of normal direction, and thereby effecting the pretreatment for electrodeposition coating and the subsequent alternating current electrodeposition coating.

According to this invention there is still further provided a method for effecting repair coating, by electrodeposition, of the end of an easy-open can where the metal has been exposed by scoring work or where the coated film has been deteriorated, which comprises using an electrodeposition bath having temperature between 20° C and 60° C, having pH between 6 and 10 adjusted by ammonia, caustic soda, caustic potash or amine and having concentration of 2 to 20%, imparting a sine wave alternating current voltage of 10 V to 300 V having the frequency of 10 Hz to 10,000 Hz as the bath voltage in an electrodeposition coating bath, using an electrode made of Ta, Nb, Zr, Al, Ti or their alloy having an oxidized film of 0.2 $\mu$ or more produced by anodic oxidation treatment, controlling the ratio and arrangement of the electrode or electrodes such that the ratio of the coating deposit current of normal direction to that of reverse direction on the inlet side of the electrodeposition coating bath is between 1 to 0.1 and 1 to 1 and such that the current of reverse direction is, as a whole, 1/10 or less of the coating deposit current of normal direction and thereby effecting the pretreatment for electrodeposition coating and the subsequent alternating current electrodeposition coating.

In one aspect of the method of this invention, a score part on the surface side of the easy-open end where the metal has been exposed or a projected part on the reverse side of said end corresponding to said score part where the coated film has been deteriorated can be subjected to a process of repair coating by electrodeposition by the use of an electrodeposition coating bath having a concentration of 2 to 20% and a temperature between 20° C and 60° C with a pH adjusted by ammonia, caustic soda, caustic potash or amine to 6 to 10. In this case, a sine wave alternating current voltage of 10 Hz to 10,000 Hz and 10 V to 300 V is imparted as a bath voltage. In carrying out the electrodeposition repair coating, the opposite electrodes are adjusted such that the ratio of the coating deposit current of normal direction (plus current portion) to that of reverse direction (minus portion) in the initial electric current is between 1:0.1 and 1:1, and the pretreatment for electrodeposition coating is effected. Thereafter a normal direct or alternating current electrodeposition coating is carried out.

In another aspect of the invention, the electrodeposition conditions such as the bath temperature, pH, concentration and the voltage used are the same as those used in the above, but the electrodes used are made of Ta, Nb, Zr, Al, Ti, or their alloys over which an oxidized film of 0.2 $\mu$ or more is provided by anodic oxidization treatment and the arrangement of the electrodes and their ratio are controlled such that the ratio of the coating deposit current of normal direction (plus portion to that of reverse direction (minus portion) on the inlet side of the electrodeposition bath is between 1:0.1 and 1:1 and such that the minus current portion is as a whole, one tenth or less of the plus current portion. Under these conditions, the pretreatment for electrodeposition coating and the subsequent alternating current electrodeposition coating are effected.

This invention is further described with respect to the drawings.

Figure 1:
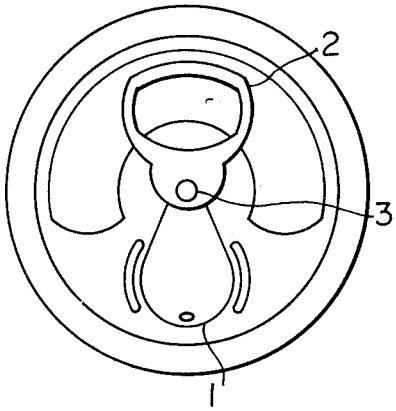
FIG. 1 is a schematic plan view illustrating one example of the surface side of an easy-open end.
Figure 2:
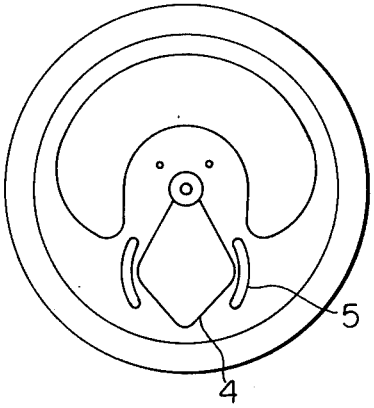
FIG. 2 is a schematic plan view showing the reverse side of the easy-open end of FIG. 1.
Figure 3:
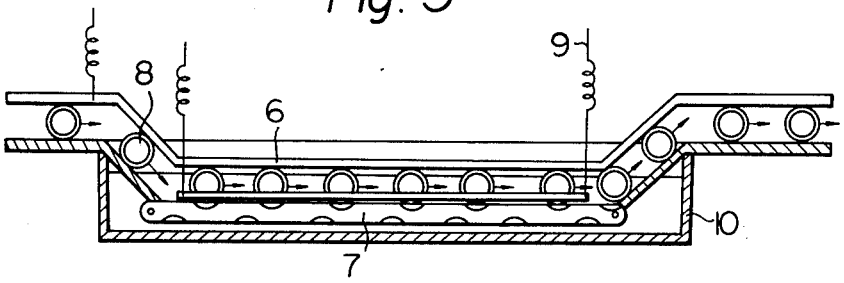
FIG. 3 shows an example of a repair coating line for the easy-open end.

In FIG. 3 showing an example of repair coating of the easy-open end, hereinafter referred to as the can end, according to this invention, the numeral 10 is an electrolytic cell, 6 is a guide for moving the can end which is concurrently utilized for passing electric current, 7 is a unit for moving the can end, 9 is an electrode having an oxidized film and 8 is the can end. The can ends 8 are transferred in the direction of arrows shown, while being subjected to (a) the pretreatment using A.C. electrodeposition coating followed by the A.C. electrodeposition coating, or (b) the pretreatment using A.C. electrodeposition coating followed by the D.C. electrodeposition coating, or (c) the pretreatment using A.C. electrodeposition coating followed by the A.C. electrodeposition coating by the use of an electrode having an oxidized film of 0.2 $\mu$ or more obtained by anodic oxidation of Ta, Nb, Zr, Al, Ti or their alloy.

The principle of the pretreatment for electrodeposition coating according to this invention is explained as follows.

In case of the enamel deposition current of normal direction, that is, when an object to be coated is an anode;

$$R(COO^-)m(\text{electrodeposition coating material}) \rightarrow$$

$$R(COOH)m \cdot R(COO^-)m \cdot m/Z\ Me^{Z+}$$

In case of the coating deposition current of reverse direction, that is, when an object to be coated is a cathode;

$$H^+ \rightarrow H_2\ (\text{gas emitted}),$$

where the degreasing or the penetration of the deteriorated film is carried out.

Remarks:

*m* is the number of the free carboxyl group per one molecule of the resin;

Z is the valence; and Me is the metal.

In the pretreatment for electrodeposition coating of the aforesaid aspects of this invention, the alternating current voltage is used where the electric current of reverse direction is fully utilized. Accordingly, the effect upon the repair property at the time of the cathode has relation not only with an amount of the electric current of normal direction but also with the kind of the electrodeposition bath used its concentration, its temperature and its voltage. The coating deposition current of normal direction is hereinafter referred to as the current of normal direction.

Generally speaking, the temperature of the bath must be kept at 20° C to 60° C according to this invention when the coating of acrylic system such as acrylic ester, acrylic polymer, the coating of butadiene system, the coating of alkyd system, the coating of maleic oil & fat system, the coating of oil-free polyester system, or the coating of epoxy system, etc. is used. If the bath temperature is more than 60° C, a neutralizing agent such as ammonia, amine, etc. is scattered. Moreover, the penetration of ion from the electrodeposition coating bath to the precoated coating is increased, which lowers the anti-corrosion property of the precoated coating. On the other hand, if the bath temperature is less than 20° C, the velocity of deposition of the coating is decreased owing to the increase of the bath resistance. Furthermore, the efficiency for electrolytic removal of the wax at the time of cathode which has been attached to the score groove during the die work is lowered, so that the property of the repair coating is degraded, the pin-hole or the peel-off of the coating occurs, and the anti-corrosion property becomes worse.

As for the adjustment of the pH of the bath, if the extreme change in the electrodeposition property due to the melt-out of the base metal into the bath is not prevented, a perfect electrodeposition repair coating to be done in such short time as 15 seconds can not be practised for the can ends which are conveyed continuously into the bath. In this case, if the base metal is aluminium, tin, or tin-free steel, the pH should be adjusted to a range of 6 to 10. The concentration of the coating should preferably be thin in case of such a complicate shape as the can end from the viewpoint of the washability or of the saving of the coating. The velocity of deposition of the coating tends to be lowered if the concentration is less than 2%. Accordingly, it should be maintained at 2 to 20%.

The shortest time that is required for the pretreatment for electrodeposition coating can be obtained experimentally by the following equation:

$$t\,[\text{sec}] = kE^{-\frac{1}{2}}F^{-\frac{1}{2}}\tau\left(\frac{293}{T+273}\right)\phi^{\frac{1}{2}}\cdot J,$$

wherein:

E: Bath voltage (A.C. Volt)

F: Frequency of electric source (Hz)

$\tau$: [current portion of normal direction]/[current portion of reverse direction]

T: Bath temperature (° C)

$\phi$: Specific resistance of bath ($\omega$-cm)

k: Coefficient determined by the particular coating and neutralizing agent used.

J: Correction value of shape of current wave (within the range of 1 to 0.5)

Ordinarily, the operation must be done for 0.1 to 10 seconds, taking the safety coefficient into account.

In case that under the above conditions the pretreatment for electrodeposition coating is effected in A.C. voltage, it is effective that the frequency of the alternating current be between 10 Hz and 10,000 Hz. When the bath voltage of 10 V or more is imparted, the electric current of reverse direction as shown in FIG. 4(b) or the cathodic electric current can prevent the electrolytic peel-off of the sound coating film which would be encountered in the pretreatment of the D.C. cathodic electrolysis, while the removal of the wax and the penetration of the deteriorated film are fully effected. However, when the bath voltage of the pretreatment for electrodeposition coating is more than 300 V, the arc will undesirably generate in the path of electric current or the pre-coating film will be undesirably scorched by the arc.

Figure 4:
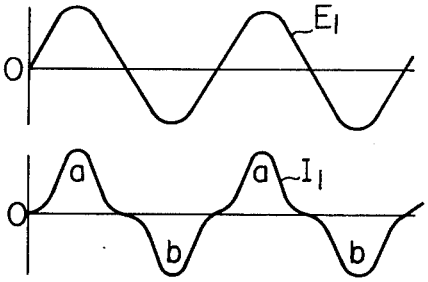
FIG. 4 shows a relation between the bath voltage and the bath current when the pretreatment for electrodeposition coating by alternating current is effected.

The relation of the bath voltage and the bath current when the pretreatment for electrodeposition coating using the alternating voltage is conducted is shown in FIG. 4, in which $E_1$ is the bath voltage and $I_1$ is the bath current passing when the opposite electrodes made of stainless steel are used. The numeral "*a*" shows the normal direction of the bath current and "*b*" shows the reverse direction thereof.

In the first-mentioned aspect of this invention, the pretreatment for electrodeposition coating is effected on the can end under the above conditions. Thereafter, the ordinary direct current electrodeposition coating or the alternating current electrodeposition coating is effected for repairing the can end in the same bath under the D.C. voltage of 50 to 500 V or the A.C. voltage of 50 to 400 V.

Figure 5:
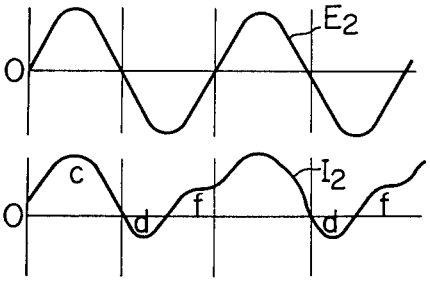
FIG. 5 shows a relation between the bath voltage $E_2$ and the bath current $I_2$ when the pretreatment for electrodeposition coating is effected by the use of an electrode of an oxidized film type which has a condenser effect enlarged by an oxidized film of 0.2 $\mu$ or more produced by anodic oxidation of Ta, Nb, Zr, Al, Ti or their alloy.

In the second-mentioned aspect of the invention, the pretreatment for electrodeposition coating is conducted on the inlet side of the alternating current electrodeposition coating. In order to obviate drastic change in the potential gradient or potential distribution in the cell by controlling the ratio and arrangement of electrodes, an electrode made of Ta, Nb, Zr, Al, Ti or their alloy having an oxidized film of 0.2$\mu$ or more given by anodic oxidation treatment is used as the electrode for the pretreatment for electrodeposition coating. It serves as the condenser to pass the phase-advancing current ($I_2$ of FIG. 5) at the time of reverse direction so as to prevent electric loss. In this case, when the electrode made of Ta, Nb, Zr, Al, Ti or their alloy having an oxidized film obtained by anodic oxidation thereof so as to enlarge the condenser action is used for the pretreatment for electrodeposition coating, the relation between the bath voltage $E_2$ and the bath current $I_2$ is shown in FIG. 5, wherein "*c*" is the coating deposit current of normal direction, "*d*" is the current of reverse direction, and "*f*" is the current of normal direction by the condenser action when the voltage of reverse direction is imparted. In this way, a stray current in the cell or an irregular repair caused thereby can be prevented. In this invention, the arrangement and the ratio of the electrodes having the oxidized film for the pretreatment electrodeposition coating are controlled on the inlet side. Particularly, the ratio of the current portions of normal and reverse directions on the inlet side are controlled such that [the coating deposit current of normal direction] : [that of reverse direction] = 1 : 0.1 ~ 1 : 1. The current portion of reverse direction is adjusted such that it is less than 1/10 of the current portion of normal direction as the overall steps, and the pretreatment for electrodeposition coating and the alternating electrodeposition coating are simultaneously effected for repair. As a result, the repair coating film on the can end which has good anti-corrosion property, good adhesion property, less fluctuation of quality of products and excellent appearance of products can be obtained for a short time.

As for the alternating voltage to be used in both aspects of the invention, it can be not only the sine wave but also any wave of irregular shape which is synthesized by the sine wave voltage of 10 Hz to 10,000 Hz as the main component so long as the ratio of the normal and reverse current portions be adjusted to 1 : 1 ~ 1 : 0.1.

The comparison of the method of this invention with the typical conventional method is shown as follows:

1. Conventional Method

→ electrodeposition coating → washing with water → curing → lacquer spray → curing →

2. The method of this invention

| (Inlet side) | (Outlet side) |
|---|---|
| → pretreatment electrodeposition coating → (special A.C. process) → washing with water → curing→ | electrodeposition coating (Ordinary D.C. or A.C. process) |

Examples of this invention are described as follows:

EXAMPLE 1

1000 pieces of can ends made of tinplate upon which epoxy urea has been precoated (No. 201 End for juice can) were subjected piece by piece to the pretreatment for electrodeposition coating in a bath cell (10cm × 10cm × 12cm) containing 1 *l* of 5% copolymer coating of acrylic ester and acrylic acid (bath temperature: 40° C, pH = 8.0) for one second per piece, wherein an opposite electrode used was a wire stainless steel (2 mm$\phi$ × 10cm); a sine wave A.C. 100 V of 50 Hz was imparted, and the ratio of electrodes was adjusted such that the electric current of normal direction: that of reverse direction = 1 : 1. Then, 500 pieces thereof were subjected piece by piece to the A.C. electrodeposition repair coating in the same bath for 3 seconds per piece, wherein a 3mmϕ × 10cm aluminium electrode over which a 3 μ oxidized film has been produced by normal anodic oxidation in 10% $H_2SO_4$ solution was used with the bath voltage of A.C. 150 V.

The remaining 500 pieces were subjected piece by piece to the D.C. electrodeposition repair coating in the same bath for 3 seconds per piece using a cathode made of 5mmϕ × 10cm stainless steel rod (SUS 27) with the bath voltage of D.C. 150 V.

As the control, 500 pieces of can ends were produced in the same bath for 4 seconds per piece, wherein they were not subjected to the pretreatment for electrodeposition coating but directly to the electrodeposition repair coating with D.C. 150 V. As a result, the products obtained according to the method of this invention were all good in the pin-hole test, process test and pack test as shown in Table 1.

Table 1

| | Properties of the can end subjected to repair coating | | | | |
|---|---|---|---|---|---|
| | Pretreatment for electro-deposition coating | Electro-deposition repair coating | Pin-hole test | Process test | Tomato juice pack test |
| 1 | A.C. 100 V, one second | A.C. 150 V, three seconds | No hole per piece | good | good |
| 2 | A.C. 100 V, one second | D.C. 150 V, three seconds | No hole per piece | good | good |
| 3 | None | D.C. 150 V, four seconds | two or three holes per piece | slightly bad | slightly bad |

Remarks:
a) Pin-hole Test: The product is dipped into an aqueous solution at 20° C of 198g/ of $CuSO_4$ and 25 cc/l of HCl for 10 minutes so as to allow the copper to deposit in the part of pin-hole or deteriorated film, thereby judging the coating condition.
b) Process Test: This is a test to judge whether the coated film can stand the heat treatment effected for sterilizing the content of the can. The product is subjected to a one-hour heat treatment by steam at 120° C in the autoclave, and then measured as to whether or not the film can be peeled off by taping.
c) Tomato Juice Pack Test: The tomato juice is packed into the product can, which is then stored at 38° C for 6 months and measured as to its anti-corrosion property.

EXAMPLE 2

1000 pieces of can ends made of tinplate upon which epoxy urea has been precoated (No. 201 End for juice can) were subjected piece by piece to the pretreatment for electrodeposition coating in a bath cell (10cm × 10cm × 12cm) containing 1 *l* of 5% epoxy ester coating (bath temperature: 40° C, pH = 8.2) for one second per piece, wherein an opposite electrode used was a wire-like titanium (4mmϕ × 10cm); a sine wave A.C. 100 V of 50 Hz was imparted, and the ratio of electrodes and the distance there between were adjusted such that the electric current of normal direction : that of reverse direction = 1 : 1. Then, 500 pieces thereof were subjected piece by piece to the A.C. electrodeposition repair coating in the same bath for 3 seconds per piece, wherein a 3mmϕ × 10cm aluminium electrode over which a 3 μ oxidized film has been produced by normal anodic oxidation in 10% $H_2SO_4$ solution was used with the bath voltage of A.C. 150 V of 50 Hz.

The remaining 500 pieces were subjected piece by piece to the D.C. electrodeposition repair coating in the same bath for 3 seconds per piece using a cathode made of 5mmϕ × 10cm stainless steel rod (SUS 27) with the bath voltage of D.C. 150 V.

As the control, 500 pieces of can ends were produced in the same bath for 4 seconds per piece, wherein they were not subjected to the pretreatment for electrodeposition coating but directly to the electrodeposition repair coating with D.C. 150V. As a result, the products obtained according to the method of this invention were all good in the pin-hole test, process test and pack test as shown in Table 2.

Table 2

| | Properties of the can end subjected to repair coating | | | | |
|---|---|---|---|---|---|
| | Pretreatment for electro-deposition coating | Electro-deposition repair coating | Pin-hole test | Process test | Tomato juice pack test |
| 1 | A.C. 100 V, one second | A.C. 150 V, three seconds | No hole per piece | good | good |
| 2 | A.C. 100 V, one second | D.C. 150 V, three seconds | No hole per piece | good | good |
| 3 | None | D.C. 150 V, four seconds | two or three holes per piece | slightly bad | slightly bad |

Remarks: Every test were conducted in the same way as in Example, 1.

EXAMPLE 3

1000 pieces of can ends made of tinplate, 1,000 pieces of can ends made of aluminium and 1,000 pieces of can ends made of tin-free steel (very thin steel sheet plated with chromate, chromium) (No. 201 End for juice can), each manufactured by punching the material which has been precoated with epoxy-phenol coating, were subjected to the electrodeposition repair coating in a bath cell (10cm × 10cm × 12cm) containing 1 *l* of 5% butadiene coating at the bath temperature of 50° C and pH of 8.0, and tested in the same manner as shown in Example 2. The result is shown in Table 3.

Table 3

| | Properties of the can end subjected to repair coating and appearance thereof | | | | | |
|---|---|---|---|---|---|---|
| | Pretreatment for electrodeposition coating | Electrodeposition repair coating | Pin-hole test | Process test | Appearance | Tomato juice pack test |
| | A.C. 100V. 1 sec. | A.C. 150V. 3 sec. | No hole per piece | good | good | good |
| 1 | A.C. 100V. 1 sec. | D.C. 150V. 3 sec. | No hole per piece | good | good | good |
| | None | D.C. 150V. 4 sec. | Two or three holes per piece | slightly bad | slightly bad | slightly bad |
| | A.C. 100V. 1 sec. | A.C. 150V. 3 sec. | No hole per piece | good | good | good |
| 2 | A.C. 100V. 1 sec. | D.C. 150V. 3 sec. | No hole per piece | good | good | fair |
| | None | D.C. 150V. 4 sec. | One or two holes per piece | slightly bad | fair | bad |
| | A.C. 100V. 1 sec. | A.C. 150V. 3 sec. | No hole | good | good | good |

Table 3-continued

| | Properties of the can end subjected to repair coating and appearance thereof | | | | | |
|---|---|---|---|---|---|---|
| | Pretreatment for electrodeposition coating | Electrodeposition repair coating | Pin-hole test | Process test | Appearance | Tomato juice pack test |
| 3 | A.C. 100V. 1 sec. | D.C. 150V. 3 sec. | per piece No hole per piece | good | good | fair |
| | None | D.C. 150V. 4 sec. | Two or three holes per piece | slightly bad | bad | slightly bad |

Remarks: "1" is the can end made of tinplate. "2" is the can end made of aluminium. "3" is the can end made of tin-free steel. The order of evaluation is as follows: good > fair > slightly bad > bad As seen from Table 3, any material which has been subjected to the pretreatment for electrodeposition coating showed good properties whether it is made of tinplate, aluminium or tin-free steel.

EXAMPLE 4

Can ends made of tinplate (No. 201 End for juice can) which have been formed from tin plates precoated with epoxy urea coating were subjected to the preliminary electrodeposition coating in the manner shown in Example 2, followed by the D.C. or A.C. electrodeposition repair coating. In this case, the frequency of the alternating voltage to be used for the pretreatment for electrodeposition coating was changed to 5 Hz, 20 Hz, 100 Hz, 500 Hz, 1000 Hz, 8000 Hz, 20,000 Hz. The result is shown in Table 4, from which it is seen that the good result can be obtained when the frequency is between 20 Hz and 8,000 Hz.

pretreatment for electrodeposition coating for one second in the cell (10cm × 10cm × 12cm) containing 1 *l* of 10% concentration of alkyd coating bath at 50° C with pH = 8.2, wherein an opposite electrode (5cm × 10cm) made of Ta having an oxidized film of 2.2 μ produced by anodic oxidation in a 5% boric acid solution was used and the ratio of the electrodes and the distance therebetween were adjusted such that the coating deposit current of normal direction: that of reverse direction = 1 : 0.8 in the can end when a sine wave A.C. 200 V of 60 Hz is imparted at the beginning. Immediately thereafter, the surface area of the opposite electrode is decreased such that the ratio of the coating deposit current of normal direction to that of reverse direction becomes 1 : 0.5 which is of the ordinary A.C. electrodeposition coating, and further the electrodeposition coating was effected for 2 seconds with A.C. 200 V, followed by washing with water, and curing at 200° C for 3 minutes.

Table 4

| | Properties of the can end subjected to repair coating and appearance thereof | | | | | |
|---|---|---|---|---|---|---|
| | Pretreatment* for electrodeposition coating | Electrodeposition repair coating | Pin-hole test | Process test | Appearance | Tomato juice pack test |
| 1 | 5 Hz | A.C. 150V. 3 sec. | one or two holes per piece | fair | slightly bad | fair |
| 2 | 5 Hz | D.C. 150V. 3 sec. | two or five holes per piece | slightly bad | " | " |
| 3 | 20 Hz | A.C. 150V. 3 sec. | No hole | good | good | good |
| 4 | 20 Hz | D.C. 150V. 3 sec. | " | " | " | " |
| 5 | 100 Hz | A.C. 150V. 3 sec. | " | " | " | " |
| 6 | 100 Hz | D.C. 150V. 3 sec. | " | " | " | " |
| 7 | 500 Hz | A.C. 150V. 3 sec. | " | " | " | " |
| 8 | 500 Hz | D.C. 150V. 3 sec. | " | " | " | " |
| 9 | 1000 Hz | A.C. 150V. 3 sec. | " | " | " | " |
| 10 | 1000 Hz | D.C, 150V. 3 sec. | " | " | " | " |
| 11 | 8000 Hz | A.C. 150V. 3 sec. | " | " | " | " |
| 12 | 8000 Hz | D.C. 150V. 3 sec. | " | " | " | " |
| 13 | 20000 Hz | A.C. 150V. 3 sec. | two or three holes per piece | fair | fair | fair |
| 14 | 20000 Hz | D.C. 150V. 3 sec. | " | slightly bad | " | " |
| 15 | None | D.C. 150V. 3 sec. | " | " | slightly bad | slightly bad |

* It was conducted for one second with a sine wave A.C. 100V of the frequencies shown in the Table.

EXAMPLE 5

Aluminium can ends and tin-free steel can ends (Very thin chromate chromium-plated steel) (No. 201 End for juice can) which have been made from the aluminium sheet and the tin-free steel sheet, respectively, precoated with epoxy urea coating were subjected to the As the control, a sample which was subjected to the A.C. electrodeposition coating for 3 seconds without the step of the pretreatment for electrodeposition coating. These materials were subjected to the pin-hole test and cola-storage test with the result shown in Table 5.

Table 5

| | Properties of the can end subjected to repair coating and appearance thereof | | | | |
|---|---|---|---|---|---|
| | Pretreatment for electro-deposition coating | Electro-deposition repair coating | Pin-hole test | Cola-storage test(3 months) | Appear-ance |
| Al-made | A.C. 200V. | A.C. 200V. | No hole | No can | good |

Table 5-continued

| | Properties of the can end subjected to repair coating and appearance thereof | | | | |
|---|---|---|---|---|---|
| | Pretreatment for electro-deposition coating | Electro-deposition repair coating | Pin-hole test | Cola-storage test(3 months) | Appear-ance |
| | 1 sec. | 2 sec. | | having holes | |
| | None | A.C. 200V. 3 sec. | 2 to 3 holes per piece | 22 cans having holes per 1000 cans | slightly bad |
| Tin-free-Steel-made | A.C. 200V. 1 sec. | A.C. 200V 2 sec. | No hole | No can having holes | good |
| | None | A.C. 200V. 2 sec. | 2 to 3 holes per piece | 18 cans having holes per 1000 cans | bad |

EXAMPLE 6

As in Example 5, aluminium-made can ends were subjected to repair coating and to various tests, except that the ratio of the coating deposit current of normal direction to that of reverse direction in the pretreatment for electrodeposition coating is changed to 1 : 2, 1 : 1, 1 : 0.7, 1 : 0.4, 1 : 0.1 and 1 : 0.08. The result is shown in Table 6.

Table 6

| | Properties of the can end subjected to repair coating and appearance thereof | | | | |
|---|---|---|---|---|---|
| | Pretreatment for electro-deposition coating *1 | Electro-deposition repair coating *3 | Pin-hole test | Cola-storage test (3 months) | Appearance of product |
| 1 | Current ratio 1 : 2 | A.C. 200V. 2 sec. | 0.5 – 1 hole per piece *2 | 2 cans having holes per 1000 cans | fair |
| 2 | Current ratio 1 : 1 | " | No hole | No hole | good |
| 3 | Current ratio 1 : 0.7 | " | No hole | No hole | " |
| 4 | Current ratio 1 : 0.4 | " | No hole | No hole | " |
| 5 | Current ratio 1 : 0.1 | " | No hole | No hole | " |
| 6 | Current ratio 1 : 0.08 | " | two-three holes per piece | 16 cans per 1000 cans | slightly bad |

Note:
*1 A.C. 200V, 1 sec. for Pretreatment for electrodeposition coating is imparted with the indicated ratios (coating deposit current of normal order: that of reverse order)
*2 "piece" is an easy-open end (E. O. E.) or can end.
*3 This is effected with A.C. 200 V. of 60 Hz and the current ratio of 1 : 0.05.

It is thus obvious from the above Table that the pretreatment for electrodeposition coating is effective for the current ratios between 1 : 1 and 1 : 0.1.

EXAMPLE 7

As in Example 2, the can end made of tinplate (No. 201 End for juice can) was subjected to the repair coating, except that the A.C. Bath voltage for the pretreatment for electrodeposition coating has been changed to 5V, 10V, 50V, 100V, 150V, 200V, 300V and 400V. The properties of the material thus repaired are shown in Table 7, from which it is seen that the best result can be obtained in the range between 10V and 300V.

Table 7

| | Properties of the can end subjected to repair coating and appearance thereof. | | | | | |
|---|---|---|---|---|---|---|
| | Pretreatment for electrodeposition coating | Electrodeposition repair coating | Pin-hole test | Apple-juice Storage test (16 months) | Peach nectar storage test (16 months) | Appear-ance of product |
| 1 | A.C. 5V | A.C. 150V. 3 sec. | 2 – 3 holes per piece | fair | slightly | fair |
| 2 | A.C. 10V | " | No hole | good | good | good |
| 3 | A.C. 50V | " | " | " | " | " |
| 4 | A.C. 100V | " | " | " | " | " |
| 5 | A.C. 150V | " | " | " | " | " |
| 6 | A.C. 200V | " | " | " | " | " |
| 7 | A.C. 300V | " | " | " | " | " |
| 8 | A.C. 400V | " | 3 – 9 holes per piece | slightly bad | slightly bad | slightly bad |
| 9 | None | A.C. 150V. 4 sec. | 2 – 3 holes | slightly bad | bad | " |

Table 7-continued

| Properties of the can end subjected to repair coating and appearance thereof. | | | | | |
|---|---|---|---|---|---|
| Pretreatment for electrodeposition coating | Electrodeposition repair coating | Pin-hole test | Apple-juice Storage test (16 months) | Peach nectar storage test (16 months) | Appearance of product |
| | | per piece | bad | | |

EXAMPLE 8

In an electrodeposition coating cell (depth 0.5m, length 3m, width 0.5m) as shown in FIG. 3, the can end 8 was moved by a guide 6 which concurrently serves to pass electric current and by a lower conveying unit 7, meanwhile it was subjected to the electrodeposition repair coating for 2 seconds with A.C. 200V between the can end and a Ta electrode 9 (Example 5) having an oxidized film provided along the path of the can end. The ratio of the electrode and the distance therebetween on the inlet side were adjusted with 8% concentration of butadiene bath (pH = 8.2, temperature 40° C) such that the ratio of the coating deposit current of normal direction to that of reverse direction was 1 to 0.5 only for 0.5 second on the inlet side while that ratio was 1 to 0.09 for the overall step. 2,000 pieces of tinplated can end, respectively for juice can, beer can, beverage can, fruit can and other foodstuff can were then subjected to repair coating using the above coating line.

As the control, the can end was subjected to the normal A.C. electrodeposition repair coating for 2 seconds without changing the ratio of the electrode on the inlet side under the ratio of the coating deposit current of normal direction to that of reverse direction being 1 : 0.05. The result of these tests is shown in Table 8, from which it is seen that the pretreatment for electrodeposition coating will serve to give excellent results of repair.

Table 8

| Properties of the can end subjected to repair coating and appearance thereof | | | | | | |
|---|---|---|---|---|---|---|
| can end | Electrodeposition repair coating | Pin-hole test | Pack test content | Pack test result of test | | Appearance |
| (1) for juice can | A with PEC* | No hole | orange | No spot rust | No can having holes | good |
| | B without PEC | 1 hole per piece | " | two spot rusts | " | fair |
| (2) for beer can | A with PEC | No hole | beer | No spot rust | " | good |
| | B without PEC | 1 - 2 holes per piece | " | two spot rusts | " | slightly bad |
| (3) for beverage can | A with PEC | No hole | Cola | No spot rust | " | good |
| | B without PEC | 1 hole per piece | " | three spot rusts | 105 cans having holes | slightly bad |
| (4) for fruit can | A with PEC | No hole | white peach | No spot rust | No can having holes | good |
| | B without PEC | 1 - 2 holes per piece | " | one spot rust | two cans having holes | fair |
| (5) for other foodstuff can | A with PEC | No hole | coffee | No spot rust | No can having holes | good |
| | B without PEC | 1 hole per piece | " | three spot rust | " | slightly bad |

*PEC = Pretreatment for electrodeposition coating

EXAMPLE 9

As in Example 5, aluminium-made can ends and tin-free-steel-made can ends (very thin chromate chromium plated steel sheet) (No. 201 for juice can) were subjected to the electrodeposition repair coating, except that the treatment time for the pretreatment for electrodeposition coating was changed to 0.01, 0.1, 0.5, 1.0, 2.0, 3.0 and 5.0 seconds, respectively. The result of test is shown in Table 9.

Table 9

| | Properties of the can end subjected to repair coating and appearance thereof | | | | |
|---|---|---|---|---|---|
| | Pretreatment for electrodeposition coating | Electrodeposition repair coating | Pin-hole test | Cola storage test (3 months) | Appearance |
| Al-made | A.C. 200V. 0.01 sec. | A.C. 200V, 2 sec. | 1 - 2 holes per piece | 5 cans having holes/1000 cans | fair |
| | A.C. 200V, 0.1 sec. | " | No hole | No can having hole | good |
| | A.C. 200V, 0.5 sec. | " | " | " | " |
| | A.C. 200V, 1.0 sec. | " | " | " | " |
| | A.C. 200V, 2.0 sec. | " | " | " | " |
| | A.C. 200V, 3.0 sec. | " | " | " | " |
| | A.C. 200V, 5.0 sec. | " | " | " | " |
| | None | A.C. 200V, 2 sec. | 2 - 3 holes | 22 cans having holes | slightly |

Table 9-continued

| | Properties of the can end subjected to repair coating and appearance thereof | | | | |
|---|---|---|---|---|---|
| | Pretreatment for electrodeposition coating | Electrodeposition repair coating | Pin-hole test | Cola storage test (3 months) | Appearance |
| | | | per piece | per 1000 cans | bad |
| | | | 1 – 2 holes | 9 cans having | slightly |
| Tin-free-steel-made | A.C. 200V, 0.01 sec. | A.C. 200V, 2 sec. | per piece | holes/1000 cans | bad |
| | A.C. 200V, 0.1 sec. | " | No hole | No can having hole | fair |
| | A.C. 200V, 0.5 sec. | " | " | " | good |
| | A.C. 200v, 1.0 sec. | " | " | " | " |
| | A.C. 200V, 2.0 sec. | " | " | " | " |
| | A.C. 200V, 3.0 sec. | " | " | " | " |
| | A.C. 200V, 5.0 sec. | " | " | " | " |
| | None | A.C. 200V, 2 sec. | 2 – 3 holes per piece | 18 cans having holes per 1000 cans | bad |

As is clear from the above Table, the effect of this invention can be recognized at the treatment time of 0.1 second or more.

As set forth hereinabove, the method of this invention displays very excellent result with simple means as compared with the conventional method of repairing an easy-open end for can.

We claim:

1. In a method for effecting repair coating of the end of an easy-open can where the metal of the end has been exposed by scoring work and where the film coating on the said end has been deteriorated including subjecting the can to a pretreatment operation for electrodeposition coating and thereafter electrodepositing a coating on said can, the improvement wherein the pretreatment for electrodeposition coating involves removing said deteriorated film coating by means of hydrogen gas formation and is effected by introducing the can into an electrodeposition coating bath as an electrode therein, impressing a sine wave alternating current voltage of about 10 volts to about 300 volts and at a frequency of about 10 Hz to about 10,000 Hz on the bath, disposing an electrode means of polarity opposite to that of said can in said bath, and controlling the ratio of the coating deposit current of normal direction to that of reverse direction in the initial electric current flow to between 1 to 0.1 and 1 to 1.

2. A method according to claim 1 in which said electrodeposition coating bath has a temperature between 20° C. and 60° C., a pH of between 6 and 10 as adjusted by one of ammonia, caustic soda, caustic potash and an amine, and a concentration of 2 to 20%.

3. A method according to claim 1 in which said electrodeposition coating is effected by the use of one of an alternating current voltage and direct current voltage after the pretreatment for electrodeposition coating is effected.

4. A method according to claim 1 in which said pretreatment for electrodeposition coating is effected for a period for about 0.1 to about 10 seconds.

5. In a method for effecting repair coating of the end of an easy-open can where the metal of the end has been exposed by scoring work and where the film coating on the end has been deteriorated including subjecting the can end to a pretreatment operation for electrodeposition coating and electrodepositing a coating on said can, the improvement wherein the pretreatment for electrodeposition coating involves removing said deteriorated film coating by means of hydrogen gas formation and is effected by introducing the can end into an electrodeposition coating bath as an electrode therein, impressing a sine wave alternating current voltage of about 10 volts to about 300 volts and at a frequency of about 10 Hz to 10,000 Hz on the bath, disposing an electrode means of polarity opposite to that of said can end in said bath and controlling the ratio of the coating deposit current of normal direction to that of reverse direction in the inlet side of the electrodeposition coating bath between 1 to 0.1 and 1 to 1 and such that the current of reverse direction is as a whole about 1/10 or less of the coating deposit current of normal direction, said electrode means being made of a material selected from the group consisting of Ta, Nb, Zr, Al, Ti, and their alloys and having an oxidized film of 0.2$\mu$ or more thereon, and thereafter effecting electrodeposition coating by the use of alternating voltage.

6. A method according to claim 5 in which said electrodeposition coating bath has a temperature between 20° C. and 60° C., a pH between 6 and 10 and adjusted by one of ammonia, caustic soda, caustic potash and an amine, and a concentration of 2 to 20%.

7. A method according to claim 6 in which said pretreatment for electrodeposition coating is effected for a period of about 0.1 to about 10 seconds.

* * * * *

UNITED STATES PATENT AND TRADEMARK OFFICE

CERTIFICATE OF CORRECTION

PATENT NO. : 4,081,344

DATED : March 28, 1978

INVENTOR(S) : Yoshio Shindou; Makoto Nakamura

It is certified that error appears in the above-identified patent and that said Letters Patent are hereby corrected as shown below:

At Col. 1, line 15, "type of can" should read --type of can body--.

At Col. 6, lines 39-40, "1:1 ~ 1:0.1" should read --1:0.1 ~ 1:1--.

At Col. 6, line 51, "pretreatment electro-" should read --pretreatment for electro---.

In Table 7 at Col. 12, under the Heading "Peach nectar storage test (16 months)", the entry for "1" should be changed from "slightly" to --slightly bad--.

Signed and Sealed this

Ninth Day of January 1979

[SEAL]

Attest:

RUTH C. MASON
Attesting Officer

DONALD W. BANNER
Commissioner of Patents and Trademarks